US009981820B2

(12) United States Patent
Yuan et al.

(10) Patent No.: US 9,981,820 B2
(45) **Date of Patent: *May 29, 2018**

(54) ACCESSORIES USABLE WITH ROLL MEDIA AND IMAGE FORMING SYSTEM HAVING OUTPUT MEMBER

(71) Applicant: HEWLETT-PACKARD DEVELOPMENT COMPANY, L.P., Houston, TX (US)

(72) Inventors: Ling-Li Yuan, Shanghai (CN); Jing Hu, Shanghai (CN); Yi-Wei Deng, Shanghai (CN); Angel Martinez Barambio, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/490,125

(22) Filed: Apr. 18, 2017

(65) Prior Publication Data

US 2017/0217710 A1 Aug. 3, 2017

Related U.S. Application Data

(63) Continuation of application No. 14/353,564, filed as application No. PCT/CN2011/001759 on Oct. 24, 2011, now Pat. No. 9,656,825.

(51) Int. Cl.
*B65H 20/16* (2006.01)
*B41J 15/04* (2006.01)

(52) U.S. Cl.
CPC ..... *B65H 20/16* (2013.01); *B41J 15/04* (2013.01); *B65H 2301/41427* (2013.01); *B65H 2301/44332* (2013.01)

(58) Field of Classification Search
CPC .... B65H 19/102; B65H 19/286; B65H 20/16; B65H 2301/41242; B65H 2301/4176;
(Continued)

(56) References Cited

U.S. PATENT DOCUMENTS 4,706,862 A 11/1987 Theilacker
5,210,583 A 5/1993 Monma
(Continued)

FOREIGN PATENT DOCUMENTS

EP 0805043 A2 11/1997
GB 2357753 7/2001
(Continued)

OTHER PUBLICATIONS

European Patent Office, Extended European Search Report for EP Appl. No. 11874706.2 dated Oct. 20, 2015 (6 pages).
(Continued)

*Primary Examiner* — Michael C McCullough
(74) *Attorney, Agent, or Firm* — HP Inc. Patent Department

(57) ABSTRACT

In some examples, an accessory usable with roll media and an image forming system having an output member, comprises a leader member to attach to the output member of the image forming system, and a clip attached to the leader member, the clip to removably attach the leader member to the roll media in an installed state. The clip includes a first section to contact a first surface of the roll media, a second section to contact a second surface of the roll media, and a magnetic unit mounted on a surface of the first section, a magnetic field of the magnetic unit to attract the first and second sections toward one another to grip the roll media.

14 Claims, 9 Drawing Sheets

(58) Field of Classification Search
CPC ..... B65H 2301/41764; B65H 2301/41766; B65H 2301/4433; B65H 2301/44332; B65H 2301/4435; B65H 2301/44342; B65H 2301/52; B65H 2301/522; B41F 13/02; B41F 13/03
See application file for complete search history.

(56) References Cited

U.S. PATENT DOCUMENTS

| | | | |
|---|---|---|---|
| 5,425,160 | A | 6/1995 | Krapf |
| 5,774,777 | A | 6/1998 | Ohtsuka et al. |
| 5,810,279 | A | 9/1998 | Rodriguez et al. |
| 6,698,959 | B2 | 3/2004 | Kaya |
| 7,065,839 | B2 | 6/2006 | Just |
| 7,621,516 | B2 | 11/2009 | Feuiltault |
| 2001/0000716 | A1 | 5/2001 | Koshi et al. |
| 2003/0015108 | A1 | 1/2003 | Singh |
| 2004/0009025 | A1 | 1/2004 | Pozuelo et al. |
| 2005/0232677 | A1 | 10/2005 | Ogawa et al. |
| 2009/0033733 | A1 | 2/2009 | Higashimoto et al. |
| 2009/0057362 | A1 | 3/2009 | Menzinger |
| 2011/0206439 | A1 | 8/2011 | Takahashi |

FOREIGN PATENT DOCUMENTS

| | | |
|---|---|---|
| JP | S5926845 | 2/1984 |
| JP | S5957432 | 4/1984 |
| WO | WO-08804616 | 6/1988 |

OTHER PUBLICATIONS

PCT Search Report—Application No. PCT/CN2011/001759 dated Aug. 9, 2012—pp. 7.

ACCESSORIES USABLE WITH ROLL MEDIA AND IMAGE FORMING SYSTEM HAVING OUTPUT MEMBER

CROSS REFERENCE TO RELATED APPLICATION

This is a continuation of U.S. application Ser. No. 14/353,564, filed Apr. 23, 2014, which is a national stage application under 35 U.S.C. § 371 of PCT/CN2011/001759, filed Oct. 24, 2011, which are both hereby incorporated by reference in their entirety.

BACKGROUND

Image forming systems such as large format printing systems may apply fluid to media. Such large format printing systems may be supplied with media in the form of roll media. The roll media may be transported along a media transport path through a print zone to selectively receive fluid and, subsequently, to an output member.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

Figure 1:
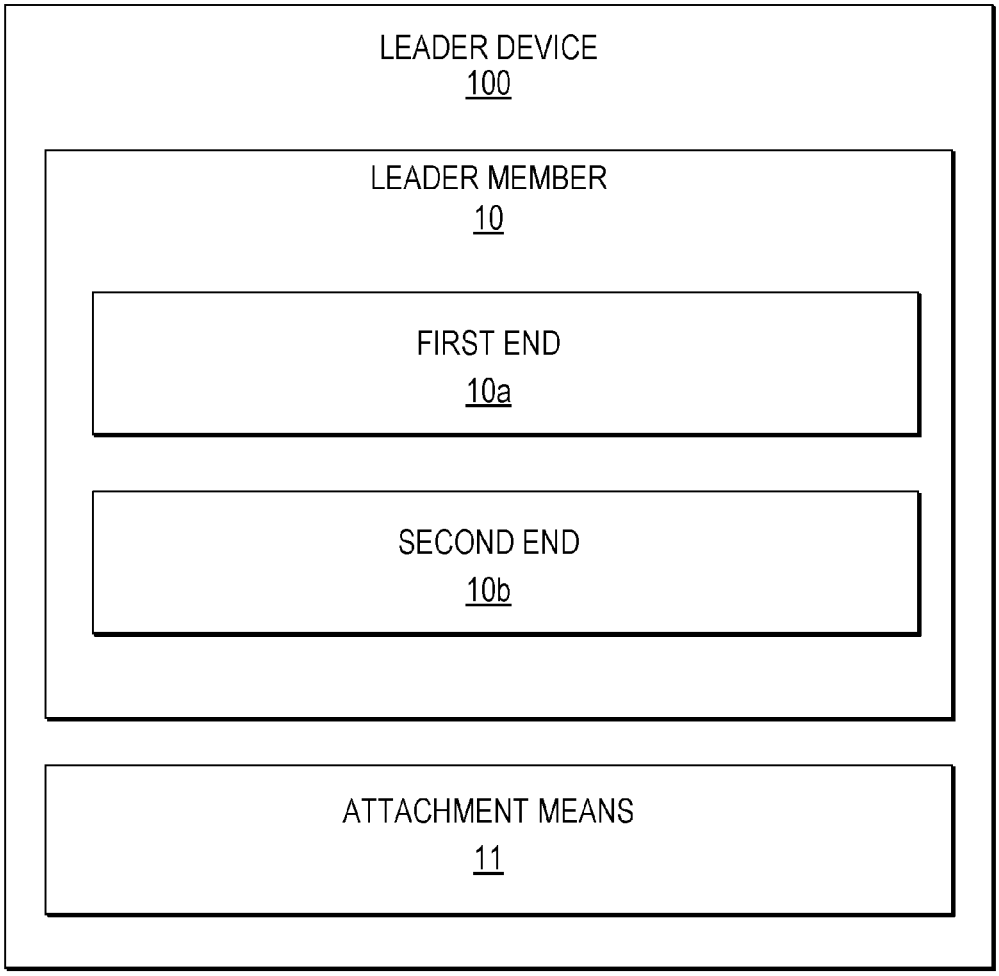
FIG. 1 is a block diagram illustrating a leader device according to an example.

In the following detailed description, reference is made to the accompanying drawings which form a part hereof, and in which is detected by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Image forming systems include large format printers that use roll media to span across a print zone to receive fluid including ink such as latex-based ink, or the like, thereon from a fluid applicator unit. That is, the roll media may be loaded across the print zone to an output member such as an output roller. The roll media may be transported in a media transport direction from the roll media to the output roller. For example, the roll media may be transported through the print zone and wound around the roller member. The image forming system may include a plurality of rollers and a platen to support, guide and/or transport the roll media. Proper and constant tension may be applied to the roll media spanning across the print zone to maintain the respective media relatively flat to reduce media transport failure, image forming system failure and/or printing defects. Roll media, for example, may correspond to media such as paper, plastic, vinyl, and other materials, being supplied in a form of a roll to receive fluid from a fluid applicator unit. An amount of the roll media that is upstream of the print zone when the roll media is initially loaded may be wasted. That is, the initial amount of roll media upstream from the print zone is positioned past the print zone and, thus, may not receive fluid from the print applicator unit. Such roll media may be expensive and, thus, the wasted media may be costly.

In examples, a leader device usable with roll media and an image forming system having an output member may include a leader device including a leader member and an attachment means for removably attaching the leader member to a leading edge of the roll media. For example, the leader device may be a media loading accessory which can be reusable and/or disposable. The cost of the leader device may be significantly less than the cost of wasted material for which it prevents. Alternatively, the leader device may be part of the output member. The leader member may include a first end and a second end. The first end may attach to the output member of the image forming system. The attachment means may be disposed on the second end of the image forming system. The attachment means may removably attach the leader member to a leading edge of the roll media. Additionally, upon initial loading of the roll media, the leader device may be positioned upstream from the print zone in lieu of an amount of roll media that would of otherwise have been wasted. Thus, the initial amount of roll media upstream from the print zone may be reduced. Accordingly, the cost corresponding to wasted material during the initial loading of roll media may be reduced.

Figure 2:
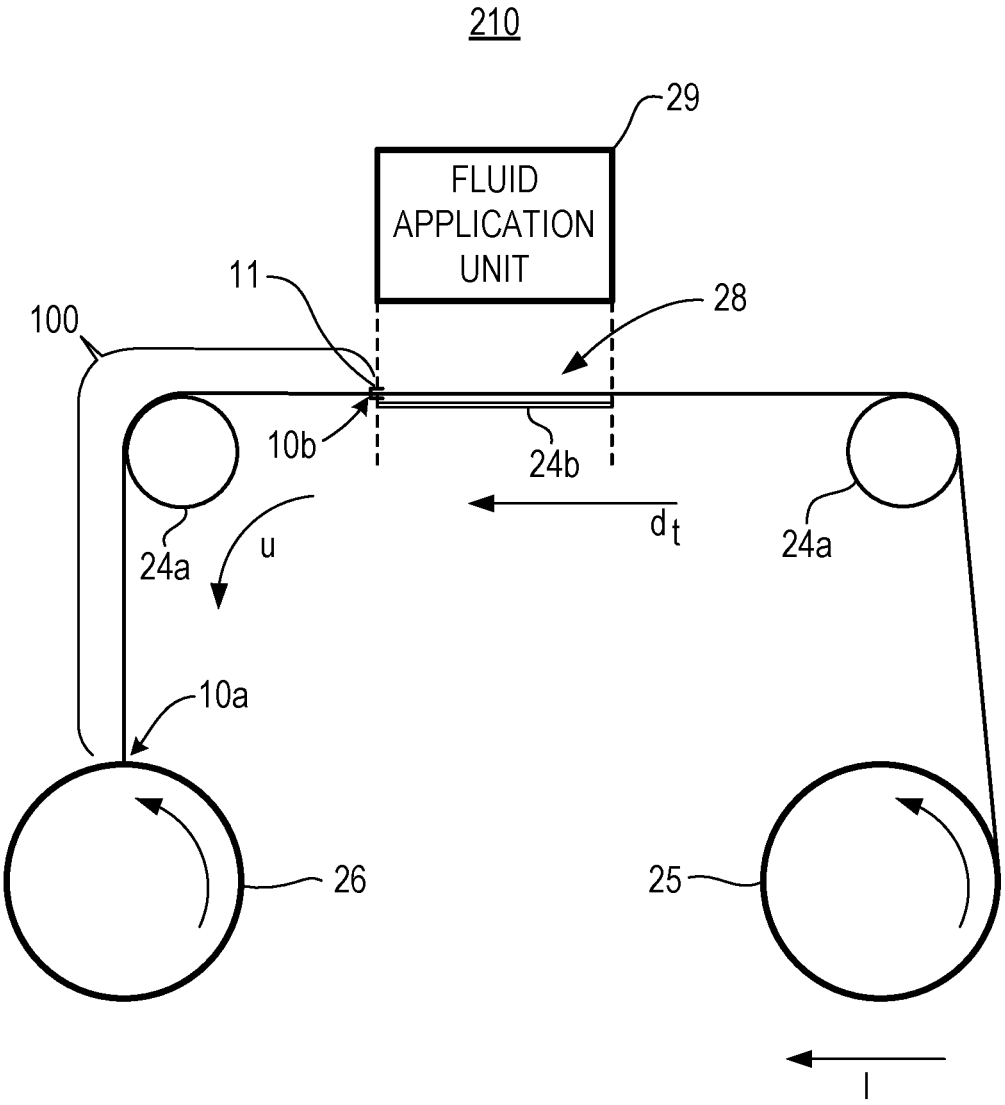
FIG. 2 is a schematic cross-sectional view illustrating the leader device attached to roll media of an image forming system according to an example.

FIG. 1 is a block diagram illustrating a leader device according to an example. FIG. 2 is a schematic cross-sectional view illustrating the leader device attached to a roll media of an image forming system according to an example. A leader device 100 may be usable with roll media 25 and an image forming system 210 having an output member 26. Referring to FIGS. 1 and 2, in some examples, the leader device 100 may include a leader member 10 and an attachment means 11. The leader member 10 may include a first end 10*a* and a second end 10*b*. The first end 10*a* of the leader member 10 may attach to the output member 26 of the image forming system 210. The output member 26, for example, may have a slot, clamp, or the like, to receive the first end 10*a* of the leader member 10. The output member 26 may be an output roller, or the like. The output roller may be a replaceable roller.

Referring to FIGS. 1 and 2, in some examples, the attachment means 11 may be disposed on the second end 10*b* of the image forming system 210 for removably attaching the leader member 10 to a leading edge 25*c* (FIG. 3F) of the roll media 25. In some examples, the leader device 100 may be positioned upstream U of the print zone 28 and span the roll media 25 across a print zone 28. Additionally, proper tension is applied to the leader device 100 and the roll media 25. The print zone 28 may be disposed across from a fluid applicator unit 29 such as a printhead, or the like, to receive the roll media 25 and selectively receive fluid there from. The roll media 25 may be transported in a media transport direction $d_t$. That is, the media transport direction $d_t$ may correspond to a direction in which the roll media 25 is transported to and from the print zone 28. In some examples, the image forming system 210 may also include a plurality of rollers 24*a* to guide and/or transport the roll media 25 onto the output member 26 and a platen 24*b* to support the roll media 25 in the print zone 28. In some examples, in the installed state, the leader device 100 is disposed upstream U from the print zone 28.

Figure 3A:
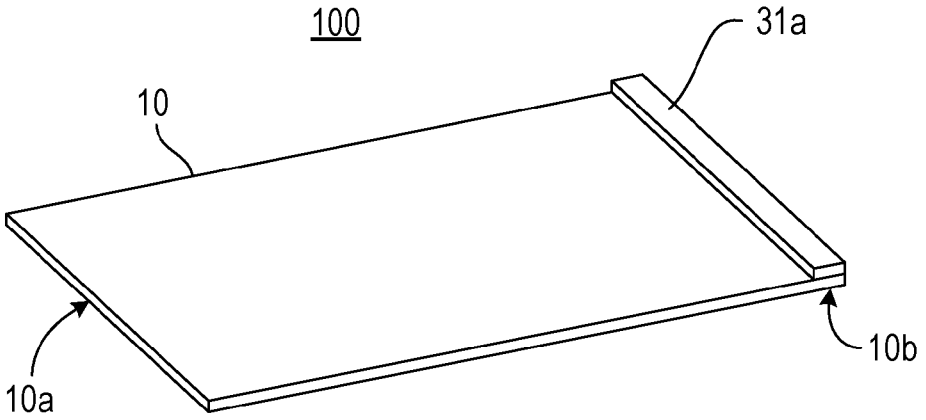
FIGS. 3A-3D are perspective views of the leader device of FIG. 1 according to examples.
Figure 3B:
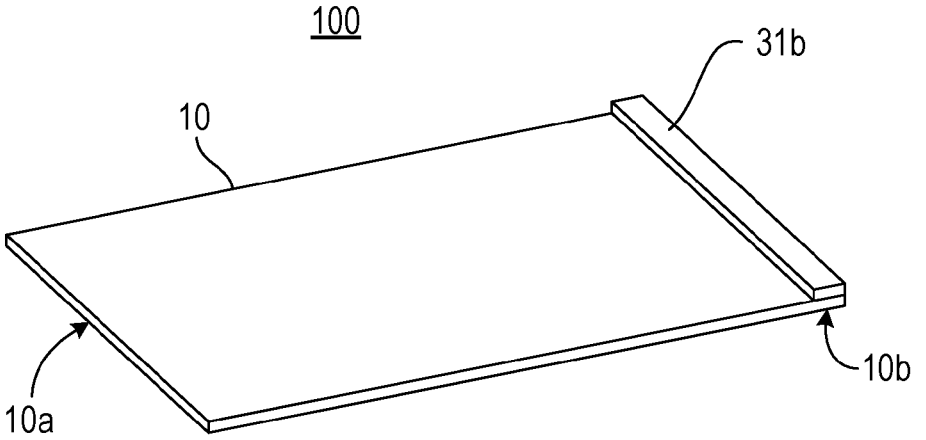
Figure 3C:
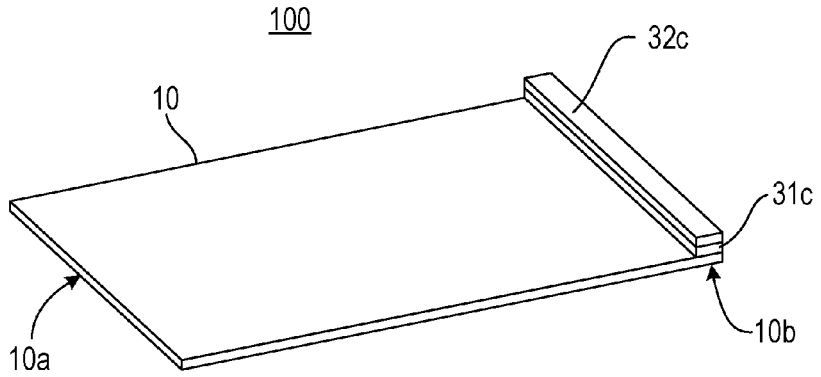

FIGS. 3A-3C are perspective views of the leader device of FIG. 1 according to examples. Referring to FIG. 3A, in some examples, the leader device 100 may include a leader member 10 and an attachment means 11 such as glue 31*a* coupled to the leader member 10. The glue 31*a*, for example, may have a range of adhesiveness to removably attach the leader member 10 to the roll media 25. That is, the leader device 100 may be sufficiently attached to the roll media 25 and maintain the proper and constant tension. Yet, the attachment means 11 such as glue may be removed from the roll media 25, for example, upon completion of printing on the respective roll media 25 or when otherwise necessary. Referring to FIG. 3B, in some examples, the leader device 100 may include a leader member 10 and an attachment means 11 such as tape 10*b* coupled to the leader member 10. For example, the tape 31*b* may be a double-sided tape. The tape 31*b*, for example, may have a range of adhesiveness to removably attach the leader member 10 to the roll media 25. The tape 11*b* may be a doubled-sided tape in which one side is attached to the leader member 10 and the other side may removably attach to the roll media 25. The tape 31*b* may have a removable tape cover (not illustrated) to cover the tape 31*b* in a cover state and expose the tape 31*b* to removably attach to the roll media 25 in an uncover state.

Referring to FIG. 3C, in some examples, the leader device 100 may include a leader member 10 and an attachment means 11 such as an adhesive 31*c* coupled to the leader member 10 and a removable adhesive cover 32*c* thereon. The adhesive 31*c*, for example, may have a range of adhesiveness to removably attach the leader member 10 to the roll media 25. The adhesive 31*c* is attached to the leader member 10 and may removably attach to the roll media 25. The removable adhesive cover 32*c* may cover the adhesive 31*c* in a cover state and expose the adhesive 31*c* to removably attach to the roll media 25 in an uncover state.

Figure 3D:
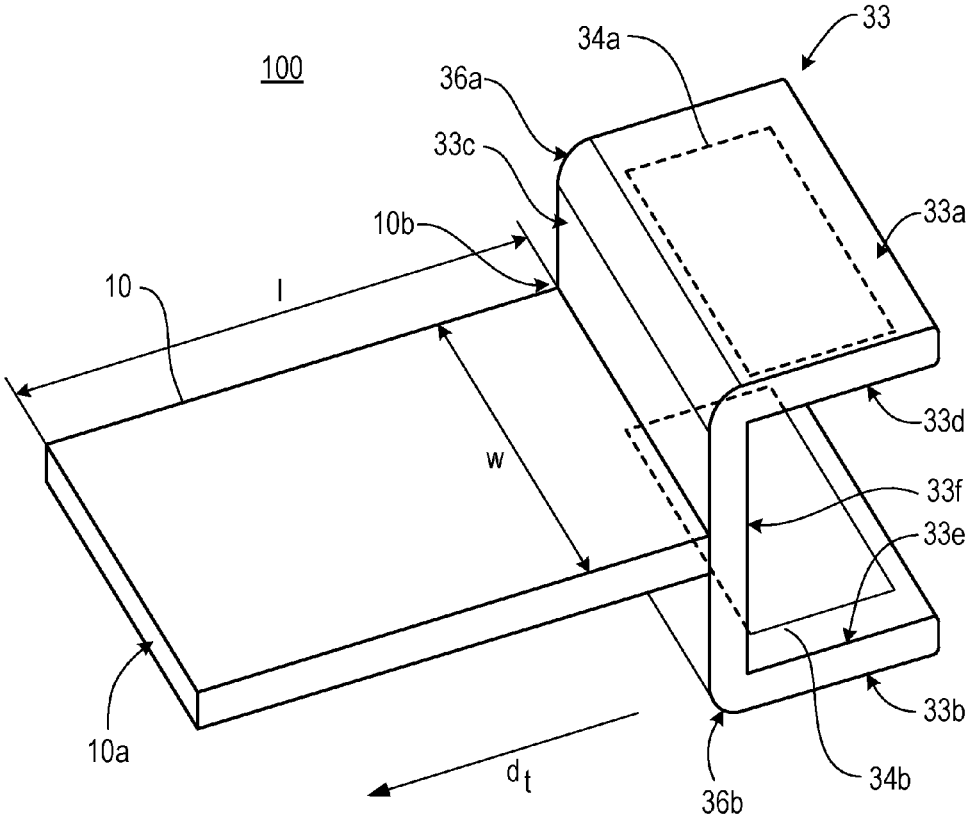
Figure 3E:
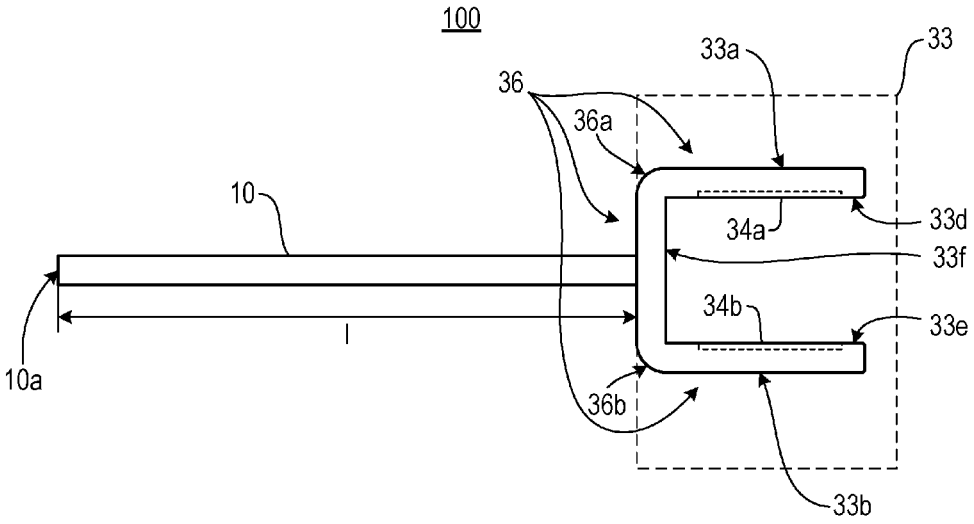
FIGS. 3E and 3F are cross-sectional views of the leader device of FIG. 3D according to examples.
Figure 3F:
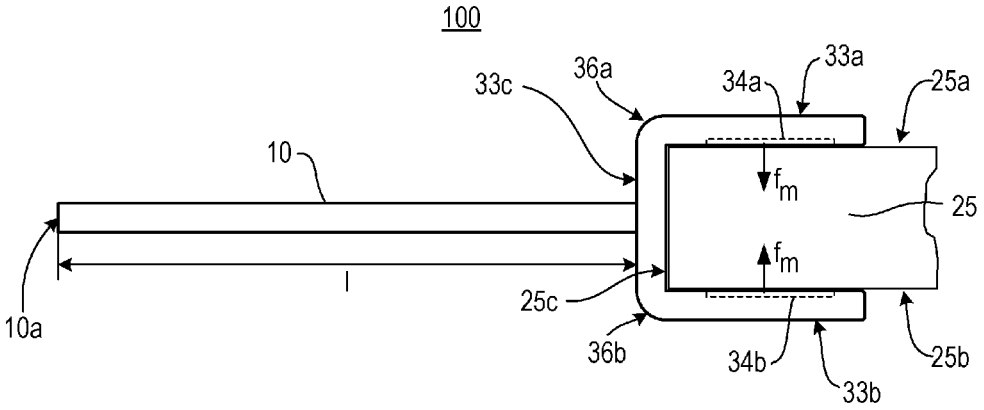

FIG. 3D is a perspective view of the leader device of FIG. 1 according to an example. FIGS. 3E and 3F are cross-sectional views of the leader device of FIG. 3D according to examples. Referring to FIGS. 3D-3F, in some examples, the leader device 100 may include a leader member 10 and an attachment means 11 such as a magnetic clip member 33 coupled to the leader member 10. The leader member 10 may also include a length l extending in a media transport direction $d_t$ and a width w perpendicular to the length l. In some examples, the leader member 10 may include plastic, or the like. The magnetic clip member 33 may extend across the width w of the leader member 10. Thus, the roll media 25 may be adequately received, orientated and gripped by the magnetic clip member 33.

Referring to FIGS. 3D-3F, in some examples, the magnetic clip member 33 may include an upper section 33*a*, a lower section 33*b*, and an intermediate section 33*c*. The upper section 33*a* may include an upper contact surface 33*d* to contact a side surface 25*a* of the roll media 25. The lower section 33*b* may include a lower contact surface 33*e* disposed across from the upper contact surface 33*d* to contact another side surface 33*e* of the roll media 25. In some examples, the lower contact surface 33*e* may include a lower gripping portion 34*b* and the upper contact surface 33*d* may include an upper gripping portion 34*a*. In some examples, the upper and lower gripping portions 34*a* and 34*b* may include a rough surface, a pad, and/or protrusions, or the like.

Referring to FIGS. 3D-3F, in some examples, the intermediate section 33*c* may include an alignment surface 33*f* to align a leading edge 25*c* of the roll media 25, for example, to reduce skew. The alignment surface 33*f* may be a wall member to contact and extend in a width-wise direction of the leading edge 25*c* of the roll media 25 in response to the magnetic clip member 33 being placed in an installed state. That is, the installed state corresponds to the roll media 25 being received by the magnetic clip member 33. The magnetic clip member 33 may also include an exterior surface 36. In some examples, the exterior surface 36 may include a first rounded corner 36*a* and a second rounded corner 36*b*. The first rounded corner 36*a* may correspond to an intersection between the intermediate section 33*c* and the upper section 33*a*. The second rounded corner 36*b* may correspond to an intersection between the intermediate section 33*c* and the lower section 33*b*. The respective rounded corners 36*a* and 36*b* may reduce damage to the roll media 25, for example, as such corners 36*a* and 36*b* contact the roll media 25 when such media 25 is wound on the output member 26. A magnetic field $f_m$, may be established between and to attract the upper section 33*a* and the lower section 33*b* toward each other to grip the roll media 25.

Figure 4:
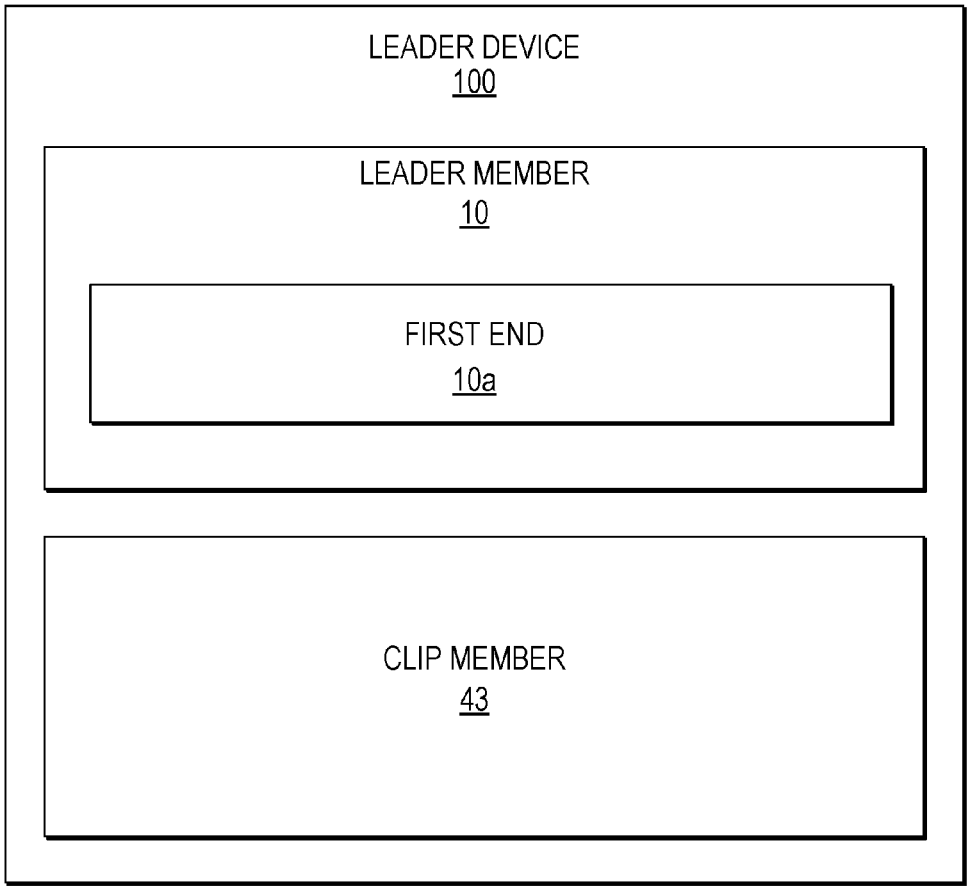
FIG. 4 is a block diagram illustrating a leader device according to an example.

FIG. 4 is a block diagram illustrating a leader device according to an example. A leader device 100 may be usable with roll media 25 and an image forming system 210 having an output member 26. Referring to FIG. 4, in some examples, the leader device 100 may include a leader member 10 and a clip member 43. The leader member 10 may include a first end 10*a* to attach to the output member 26 of the image forming system 210. In some examples, the leader member 10 may include plastic, or the like. The clip member 43 may be coupled to the leader member 10. The clip member 43 may removably attach the leader member 10 to the roll media 25 in an installed state. In some examples, the clip member 43 may include metal, or the like.

Figure 5A:
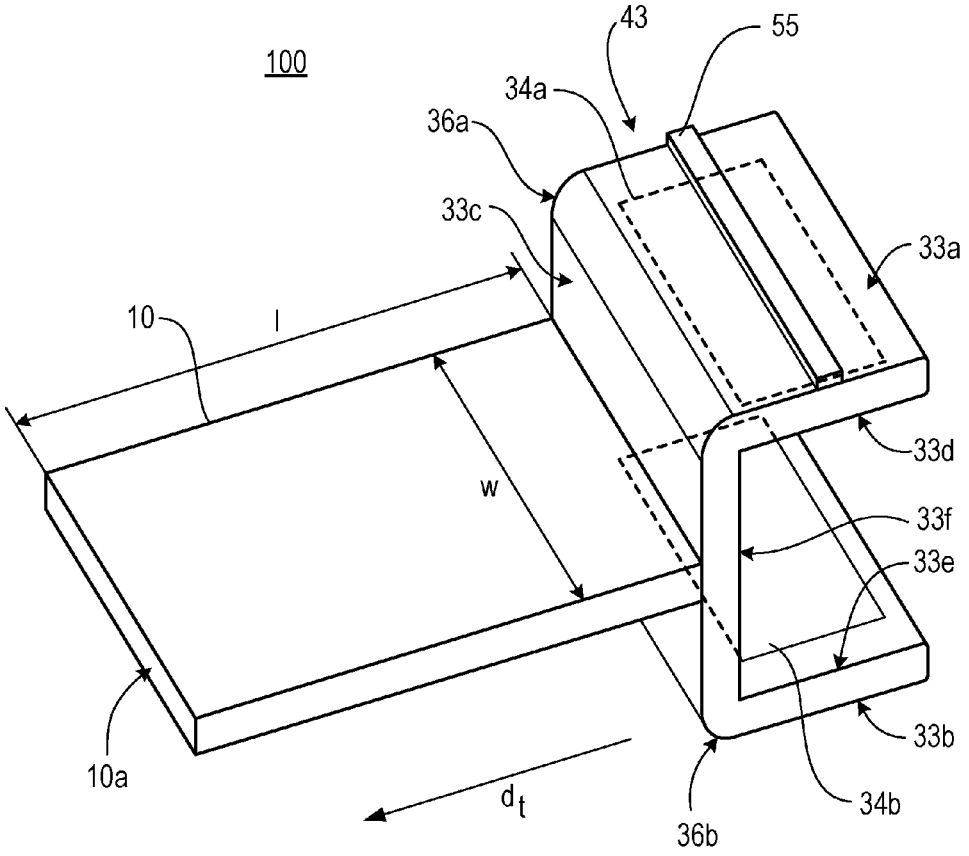
FIG. 5A is a perspective view of the leader device of FIG. 4 according to an example.
Figure 5B:
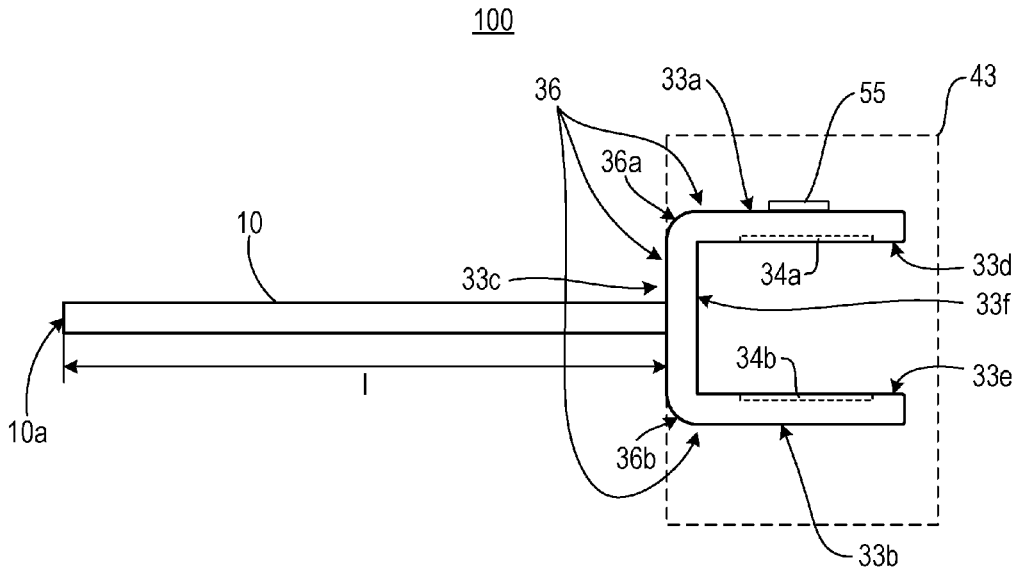
FIGS. 5B and 5C are cross-sectional views of the leader device of FIG. 5A according to examples.
Figure 5C:
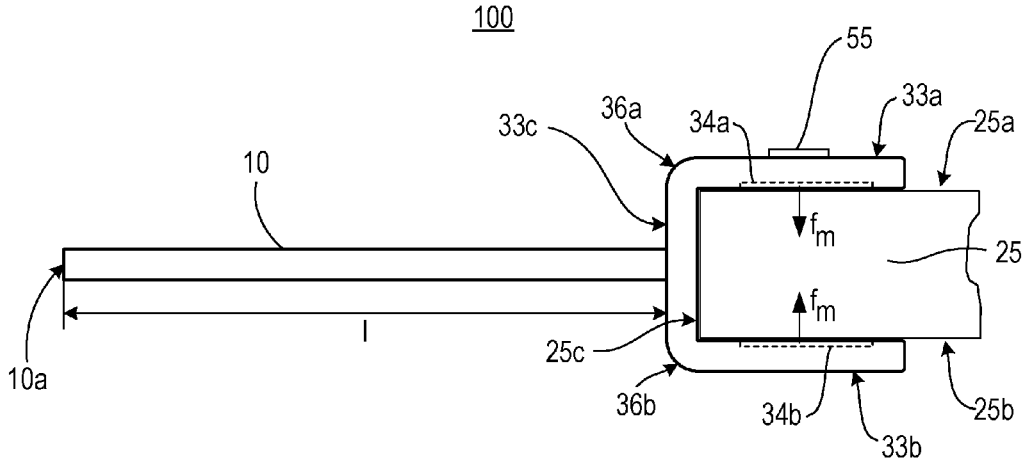

FIG. 5A is a perspective view of the leader device of FIG. 4 according to an example. FIGS. 5B and 5C are cross-sectional views of the leader device of FIG. 5A according to examples. Referring to FIGS. 5A-5C, in some examples, the leader device 10 may include a leader member 10 and a clip member 43 as previously disclosed with respect to FIG. 4. The leader member 10 may include a length l extending in a media transport direction $d_t$ and a width w perpendicular to the length l. The clip member 43 may also include an upper section 33*a*, a lower section 33*b*, and an intermediate section 33*c* disposed between the upper section 33*a* and the lower section 33*b*. The upper section 33*a* may include an upper contact surface 33*d* to contact a side surface 25*a* of the roll media 25 in an installed state. The lower section 33*b* may include a lower contact surface 33*e* disposed across from the upper contact surface 33*d* to contact another side surface 25*b* of the roll media 25 in the installed state.

Referring to FIGS. 5A-5C, in some examples, the intermediate section 33*c* may include an alignment surface 33*f* to align a leading edge 25*c* of the roll media 25, for example, to reduce skew in the installed state. The alignment surface 33*f* may be a wall member to selectively contact and extend in a width-wise direction of the leading edge 25*c* of the roll media 25 in response to the clip member 43 being placed in an installed state. That is, the installed state corresponds to the roll media 25 being received by the clip member 43. In some examples, the upper contact surface 33*d* of the upper section 33*a* may include an upper gripping portion 34*a* and the lower contact surface 33*e* of the lower section 33*b* may include a lower gripping portion 34*b*. For example, the upper and lower gripping portions 34*a* and 34*b* may include a rough surface, a pad, and/or protrusions, or the like.

Referring to FIGS. 5A-5C, in some examples, the clip member 43 may also include a magnetic unit 55 coupled to at least one of the upper section 33*a*, the lower section 33*b* and the intermediate section 33*c*. The magnetic unit 55 may establish a magnetic field $f_m$ between and to attract the upper section 33*a* and the lower section 33*b* toward each other to grip the roll media 25 in the installed state. For example, the upper section 33*a* may have a magnet disposed therein. Additionally, the lower section 33*b* may include and/or have a ferromagnetic member disposed thereon. The clip member 43 may be in a form of a magnetic clip member 33 (FIGS. 3D-3F) to establish a magnetic field $f_m$ between and to attract the upper section 33*a* and the lower section 33*b* toward each other to grip the roll media 25 in the installed state. For example, the magnetic clip member 33 itself may include ferromagnetic material, or the like.

Referring to FIGS. 5A-5C, in some examples, the clip member 43 may also include an exterior surface including a first rounded corner 36*a* and a second rounded corner 36*b*. The first rounded corner 36*a* may correspond to an intersection between the intermediate section 33*c* and the upper section 33*a*. The second rounded corner 36*b* may correspond to an intersection between the intermediate section 33*c* and the lower section 33*b*. The clip member 43 may extend across the width w of the leader member 10. Thus, the roll media 25 may be adequately received, orientated and gripped by the clip member 43. The upper section 33*a*, the lower section 33*b* and the intermediate section 33*c* of the clip member 33 may be formed of a single unitary and integral member. For example, the single unitary and integral member may be a piece of sheet metal.

Figure 6:
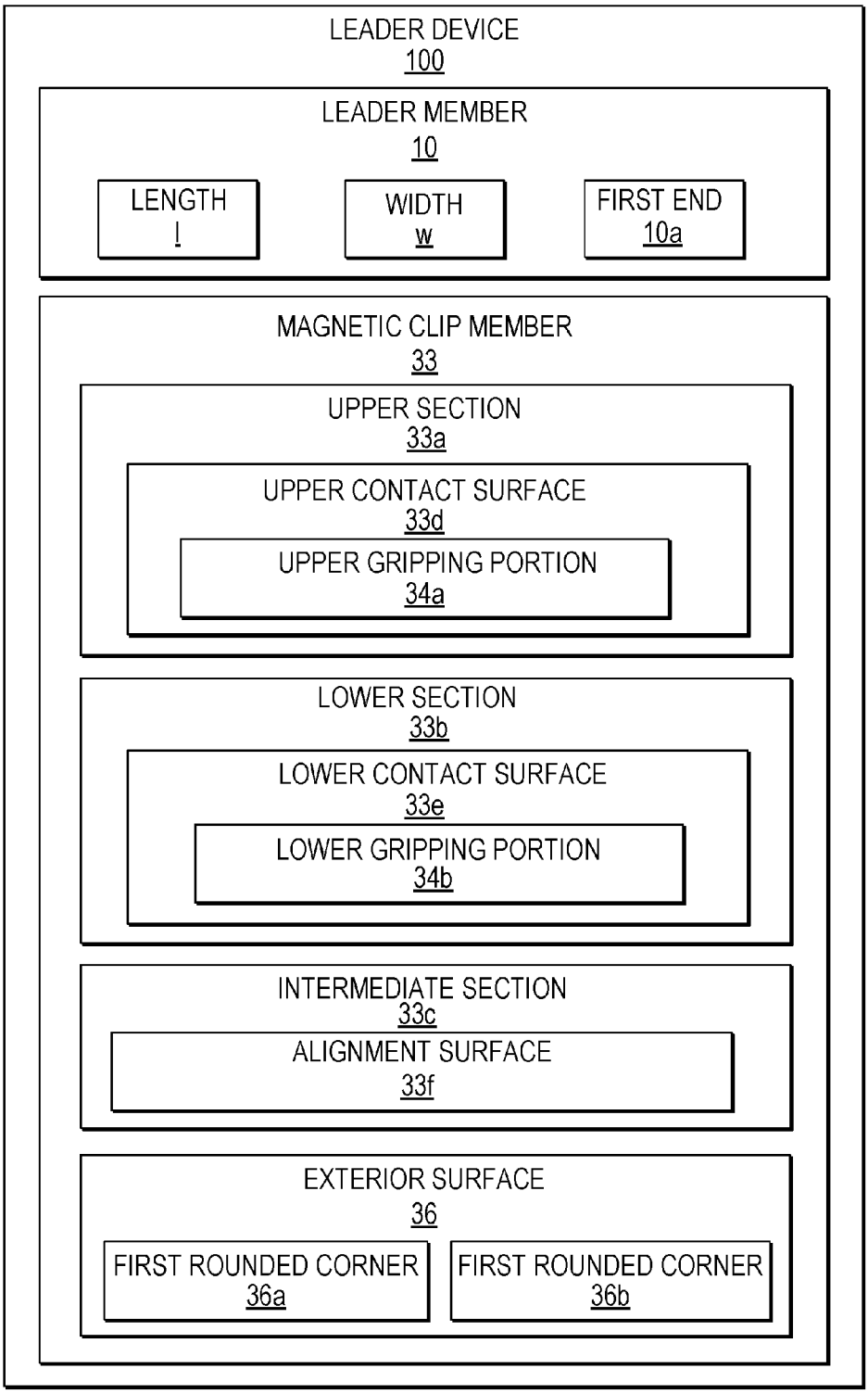
FIG. 6 is a block diagram illustrating a leader device according to an example.

FIG. 6 is a block diagram illustrating a leader device according to an example. A leader device 100 may be usable with roll media 25 and an image forming system 210 having an output member 26. Referring to FIG. 6, in some examples, the leader device 100 may include a leader member 10 and a magnetic clip member 33. The leader member 10 may include a length l, a width w and a first end 10*a*. The length l may extend in a media transport direction $d_t$. The width w may be perpendicular to the length l such that the magnetic clip member 33 extends across the width w of the leader member 10. The first end 10*a* of the leader member 10 may attach to the output member 26 of the image forming system 210. The leader device 100 may also include a magnetic clip member 33 coupled to the leader member 10. The leader member 10 may include plastic, or the like.

Referring to FIG. 6, in some examples, the magnetic clip member 33 may include an upper section 33*a*, a lower section 33*b*, an intermediate section 33*c*, and an exterior surface 36. The upper section 33*a* may include an upper contact surface 33*d* to contact a side surface 25*a* of the roll media 25. The upper contact surface 33*d* may include an upper gripping portion 34*a*. The lower section 33*b* may include a lower contact surface 33*e* disposed across from the upper contact surface 33*d* to contact another side surface 25*b* of the roll media 25. The lower contact surface 33*e* may include a lower gripping portion 34*b*. In some examples, the upper and lower gripping portions 34*a* and 34*b* may include a rough surface, a pad, and/or protrusions, or the like. The intermediate section 33*c* may include an alignment surface 33*f* to align a leading edge 25*c* of the roll media 25, for example, to reduce skew. The alignment surface 33*f* may be a wall member to selectively contact and extend in a width-wise direction of the leading edge 25*c* of the roll media 25 in response to the magnetic clip member 33 being placed in an installed state. That is, the installed state corresponds to the roll media 25 being received by the magnetic clip member 33.

Referring to FIG. 6, in some examples, a magnetic field $f_m$ (FIG. 3F) may be established between the upper section 33*a* and the lower section 33*b* to attract the upper section 33*a* and lower section 33*b* toward each other to grip the roll media 25. For example, at least one of the upper and lower section 33*a* and 33*b* may move toward the other one of the upper and lower section 33*a* and 33*b* and contact a respective side 25*a* and 25*b* of the roll media 25 in the installed state. The exterior surface 36 may include a first rounded corner 36*a* and a second rounded corner 36*b*. The first rounded corner 36*a* may correspond to an intersection between the intermediate section 33*c* and the upper section 33*a*. The second rounded corner 36*b* may correspond to an intersection between the intermediate section 33*c* and the lower section 33*b*. The respective rounded corners 36*a* and 36*b* may reduce damage to the roll media 25, for example, as such corners 36*a* and 36*b* contact the roll media 25 when such media is wound on the output member 26. The magnetic clip member 33 may include metal such as sheet metal, or the like.

The present disclosure has been described using non-limiting detailed descriptions of examples thereof. Such examples are not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may describe examples contemplated by the inventors and therefore may include structure, acts or details of structures and acts that may not be essential to the present disclosure and which are described as examples. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. An accessory usable with roll media and an image forming system having an output member, the accessory comprising:

a leader member to attach to the output member of the image forming system; and a clip attached to the leader member, the clip to removably attach the leader member to the roll media in an installed state, the clip comprising:

a first section to contact a first surface of the roll media, a second section to contact a second surface of the roll media, and a magnetic unit mounted on a first surface on a first side of the first section, the first section further comprising a second surface on a second side of the first section opposite the first side of the first section, the second surface of the first section to contact the first surface of the roll media when the roll media is gripped by the clip, and a magnetic field of the magnetic unit to attract the first and second sections toward one another to grip the roll media.

2. The accessory of claim 1, wherein the second section comprises a ferromagnetic material.

3. The accessory of claim 1, wherein the second surface of the first section is to grip the first surface of the roll media, and the second section comprises a surface to grip the second surface of the roll media.

4. The accessory of claim 1, wherein the magnetic unit protrudes beyond the first surface of the first section.

5. The accessory of claim 4, wherein the first section is spaced apart from the second section.

6. The accessory of claim 1, wherein the leader member has a length extending in a media transport direction and a width perpendicular to the length, and the clip extends across the width of the leader member.

7. The accessory of claim 1, wherein the leader member comprises a plastic material.

8. A method of providing an accessory usable with roll media and an image forming system having an output member, the method comprising:

providing a leader member attachable to the output member of the image forming system; and attaching a clip to the leader member, the clip to removably attach the leader member to the roll media in an installed state, the clip comprising:

a first section to contact a first surface of the roll media, a second section to contact a second surface of the roll media, and a magnetic unit mounted on a first surface on a first side of the first section, the first section further comprising a second surface on a second side of the first section opposite the first side of the first section, the second surface of the first section to contact the first surface of the roll media when the roll media is gripped by the clip, and a magnetic field of the magnetic unit to attract the first and second sections toward one another to grip the roll media.

9. The method of claim 8, wherein the second section comprises a ferromagnetic material.

10. The method of claim 8, wherein the first section comprises a gripping portion to grip the first surface of the roll media, and the second section comprises a gripping portion to grip the second surface of the roll media.

11. The method of claim 8, wherein the magnetic unit protrudes beyond the first surface of the first section.

12. The method of claim 11, wherein the first section is spaced apart from the second section.

13. The method of claim 8, wherein the leader member has a length extending in a media transport direction and a width perpendicular to the length, and the clip extends across the width of the leader member.

14. The method of claim 8, wherein the leader member comprises a plastic material.

* * * * *